US006190236B1

(12) United States Patent
Drill

(10) Patent No.: US 6,190,236 B1
(45) **Date of Patent: *Feb. 20, 2001**

(54) METHOD AND SYSTEM FOR VACUUM REMOVAL OF CHEMICAL MECHANICAL POLISHING BY-PRODUCTS

(75) Inventor: Charles Franklin Drill, Boulder Creek, CA (US)

(73) Assignee: VLSI Technology, Inc., San Jose, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/732,165

(22) Filed: Oct. 16, 1996

(51) Int. Cl.[7] ..... B24B 49/00

(52) U.S. Cl. ..... 451/41; 451/288; 451/56; 451/443; 451/456; 451/285

(58) Field of Search ..... 451/456, 443, 451/41, 285, 287, 288, 56, 444

(56) References Cited

U.S. PATENT DOCUMENTS 3,549,439 * 12/1970 Kaveggia et al. .
5,433,650 * 7/1995 Winebarger ..... 451/41
5,490,809 * 2/1996 Jones et al. ..... 451/446
5,584,749 * 12/1996 Mitsuhashi et al. ..... 451/41

* cited by examiner

*Primary Examiner*—Eileen P. Morgan
(74) *Attorney, Agent, or Firm*—Wagner, Murabito & Hao LLP

(57) ABSTRACT

The present invention is a vacuum removal system for removing polishing by-products from the surface of a polishing pad in a chemical mechanical polishing (CMP) machine used to polish wafers. The vacuum removal system includes a vacuum removal nozzle which is adapted to dislodge and remove polishing by-product particles from a textured surface of a polishing pad through the application of suction. The vacuum removal nozzle is connected to a mounting attachment. The mounting attachment is mounted on the polishing machine and is adapted to maintain close proximity of the vacuum removal nozzle with the textured surface of the polishing pad. A vacuum line is connected to the vacuum nozzle to convey a vacuum to the vacuum nozzle and to receive the polishing by-product particles from the vacuum nozzle. A vacuum source is connected to the vacuum line to generate the vacuum used by the system.

19 Claims, 14 Drawing Sheets

METHOD AND SYSTEM FOR VACUUM REMOVAL OF CHEMICAL MECHANICAL POLISHING BY-PRODUCTS

FIELD OF THE INVENTION

The field of the present invention pertains to semiconductor fabrication processing. More particularly, the present invention relates to a system for removing polishing by-products of a semiconductor wafer and polishing pad from a chemical mechanical polishing machine.

BACKGROUND OF THE INVENTION

Most of the power and usefulness of today's digital IC devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built up layers, each layer having components, each layer having differing interconnections, and each layer stacked on top of the previous layer. The resulting topography of these complex IC's often resemble familiar terrestrial "mountain ranges", with many "hills" and "valleys" as the IC components are built up on the underlying surface of the silicon wafer.

In the photolithography process, a mask image, or pattern, defining the various components, is focused onto a photosensitive layer using ultraviolet light. The image is focused onto the surface using the optical means of the photolithography tool, and is imprinted into the photosensitive layer. To build ever smaller features, increasingly fine images must be focused onto the surface of the photosensitive layer, i.e. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable, and thus, the smallest components obtainable using the photolithography tool. The extreme topography of complex ICs, the "hills" and "valleys," exaggerate the effects of decreasing depth of focus. Thus, in order to properly focus the mask image defining sub-micron geometries onto the photosensitive layer, a precisely flat surface is desired. The precisely flat (i.e. fully planarized) surface will allow for extremely small depths of focus, and in turn, allow the definition and subsequent fabrication of extremely small components.

Chemical-mechanical polishing (CMP) is the preferred method of obtaining full planarization of a wafer. It involves removing a sacrificial layer of dielectric material using mechanical contact between the wafer and a moving polishing pad saturated with slurry. Polishing flattens out height differences, since high areas of topography (hills) are removed faster than areas of low topography (valleys). Polishing is the only technique with the capability of smoothing out topography over millimeter scale planarization distances leading to maximum angles of much less than one degree after polishing.

FIG. 1 shows a down view of a CMP machine 100 and FIG. 2 shows a side view of the CMP machine 100. The CMP machine 100 is fed wafers to be polished. The CMP machine 100 picks up the wafers with an arm 101 and places them onto a rotating polishing pad 102. The polishing pad 102 is made of a resilient material and is textured, often with a plurality of predetermined groves 103, to aid the polishing process. The polishing pad 102 rotates on a platen 104, or turn table located beneath the polishing pad 102, at a predetermined speed. A wafer 105 is held in place on the polishing pad 102 and the arm 101 by a carrier ring 112 and a carrier film 106. The lower surface of the wafer 105 rests against the polishing pad 102. The upper surface of the wafer 105 is against the lower surface of the carrier film 106 of the arm 101. As the polishing pad 102 rotates, the arm 101 rotates the wafer 105 at a predetermined rate. The arm 101 forces the wafer 105 into the polishing pad 102 with a predetermined amount of down force. The CMP machine 100 also includes a slurry dispense arm 107 extending across the radius of the polishing pad 102. The slurry dispense arm 107 dispenses a flow of slurry onto the polishing pad 102.

The slurry is a mixture of de ionized water and polishing agents designed to chemically aid the smooth and predictable planerization of the wafer. The rotating action of both the polishing pad 102 and the wafer 105, in conjunction with the polishing action of the slurry, combine to planerize, or polish, the wafer 105 at some nominal rate. This rate is referred to as the removal rate. A constant and predictable removal rate is important to the uniformity and through put performance of the wafer fabrication process. The removal rate should be expedient, yet yield precisely planerized wafers, free from surface anomalies. If the removal rate is too slow, the number of planarized wafers produced in a given period of time decreases, hurting wafer through-put of the fabrication process. If the removal rate is too fast, the CMP planarization process will not be uniform across the surface of the wafers, hurting the yield of the fabrication process.

To aid in maintaining a stable removal rate, the CMP machine 100 includes a conditioner assembly 120. The conditioner assembly 120 includes a conditioner arm 108, which extends across the radius of the polishing pad 102. An end effector 109 is connected to the conditioner arm 108. The end effector 109 includes an abrasive conditioning disk 110 which is used to roughen the surface of the polishing pad 102. The conditioning disk 110 is rotated by the conditioner arm 108 and is translationally moved towards the center of the polishing pad and away from the center of the polishing pad 102, such that the conditioning disk 110 covers the radius of the polishing pad 102. In so doing, conditioning disk 110 covers the surface area of the polishing pad 102, as polishing pad 102 rotates. A polishing pad having a roughened surface has an increased number of very small pits and gouges in its surface from the conditioner assembly 120 and therefore produces a faster removal rate via increased slurry transfer to the surface of the wafer. Without conditioning, the surface of polishing pad 102 is smoothed during the polishing process and removal rate decreases dramatically. The conditioner assembly 120 re-roughens the surface of the polishing pad 102, thereby improving the transport of slurry and improving the removal rate.

As described above, the CMP process uses an abrasive slurry on a polishing pad. The polishing action of the slurry is comprised of an abrasive frictional component and a chemical component. The abrasive frictional component is due to the friction between the surface of the polishing pad, the surface of the wafer, and abrasive particles suspended in the slurry. The chemical component is due to the presence in the slurry of polishing agents which chemically interact with the material of the dielectric layer. The chemical component of the slurry is used to soften the surface of the dielectric layer to be polished, while the frictional component removes material from the surface of the wafer.

Referring still to FIG. 1 and FIG. 2, the polishing action of the slurry determines the removal rate and removal rate uniformity, and thus, the effectiveness of the CMP process. As slurry is "consumed" in the polishing process, the transport of fresh slurry to the surface of the wafer 105 and the removal of polishing by-products away from the surface of the wafer 105 becomes very important in maintaining the removal rate. Slurry transport is facilitated by the texture of the surface of the polishing pad 102. This texture is comprised of both predefined pits and grooves 103 that are manufactured into the surface of the polishing pad 102 and the inherently rough surface of the material from which the polishing pad 102 is made.

The slurry is transported by the grooves 103 of the polishing pad 102 and is transported under the edges of the wafer 105 as both the polishing pad 102 and the wafer 105 rotate. Consumed slurry and polishing byproducts, in a similar manner, are also transported by the grooves 103 of the polishing pad 102 and are transported away from the surface of the wafer 105. As the polishing process continues, fresh slurry is continually dispensed onto the polishing pad from the slurry dispense arm 107. The polishing process continues until the wafer 105 is sufficiently planerized and removed from the polishing pad 102.

To maintain the required degree of roughness in the surface of the polishing pad 102, the conditioner assembly 120 re-roughens the surface of the polishing pad 102 to counteract the smoothing effect of friction with the wafer 105. Unfortunately, the abrasive action of the conditioning disk 110 produces debris (hereafter polishing by-product particles) comprised of particles of polishing pad material, particles of dielectric material from the wafer, particles of consumed slurry, and the like. These polishing byproduct particles subsequently clog the predetermined grooves 103 or pits manufactured into the surface of the polishing pad 102 and reduce their ability to transport slurry and polishing by-products, adversely impacting the removal rate. Additionally, the polishing by-product particles can adhere to the surface of the wafer 105 and contribute to higher contamination levels.

CMP machines of the prior art typically rely upon a periodic "rinse" of the polishing pad 102 and the centrifugal force of the rotating platen 104 to remove the polishing by-product particles from the surface of polishing pad 102. Even if the polishing by-product particles are dislodged by these or other prior art methods, the polishing by-product particles may be merely moved to another location on the surface of the polishing pad 102. Thus, in CMP machines of the prior art, a down time is required to change out the polishing pad 102. This down time has an adverse effect on the wafer through put of the fabrication process due to the fact that the CMP machine 100 is unusable for a significant amount of time during the change out of the polishing pad 102.

Thus, what is desired is a system which improves the performance of a polishing pad in a CMP machine. What is further desired is a system which maintains a higher removal rate over a longer period of time. What is further desired is a system which increases the period of time a polishing pad may be utilized in a CMP machine before incurring a time consuming down time for polishing pad change out. The present invention provides a solution to the above needs.

SUMMARY OF THE INVENTION

The present invention comprises a vacuum removal system for removing polishing by-product particles from the surface of a polishing pad in a chemical mechanical polishing (CMP) machine used to polish wafers. The vacuum removal system includes a vacuum removal nozzle which is adapted to dislodge and remove polishing by-product particles from a textured surface of a polishing pad through the application of suction. The vacuum removal nozzle is connected to a mounting attachment. The mounting attachment is mounted on the polishing machine and is adapted to maintain close proximity of the vacuum removal nozzle with the textured surface of the polishing pad. A vacuum line is connected to the vacuum nozzle to convey a vacuum to the vacuum nozzle and to receive the polishing by-product particles from the vacuum nozzle. A vacuum source is connected to the vacuum line to generate the vacuum used by the system. The vacuum removal system of the present invention improves the performance of the polishing pad by removing the polishing by-product particles from the textured surface of the polishing pad. In so doing, the present invention maintains a higher removal rate over a longer period of time. The vacuum removal system of the present invention, in addition, increases the period of time a polishing pad may be utilized in the CMP machine before incurring a time consuming down time for polishing pad change out.

In another embodiment of the present invention, the vacuum removal nozzle is comprised of a plurality of fixed vacuum ports mounted on a conditioner arm of a CMP machine. The fixed vacuum ports are adapted to maintain close proximity with the surface of the polishing pad and, as the polishing pad rotates beneath the fixed vacuum ports, dislodge and remove by suction polishing by-product particles from the surface of the polishing pad, thereby ensuring optimal polishing conditions for the wafer.

In yet another embodiment of the present invention, the vacuum removal nozzle is comprised of a single vacuum port mounted on a conditioner arm of a CMP machine. The vacuum port is adapted to maintain close proximity with the surface of the polishing pad and scan toward and away from the center of the polishing pad such that the vacuum port covers nearly the entire surface of polishing pad, following an end effector of the conditioner arm, dislodging and removing by suction polishing by-product particles from the surface of the polishing pad.

In yet another embodiment of the present invention, a slurry container is connected to the vacuum source of the present invention. The slurry container is adapted to receive the slurry and polishing by-product particles removed from the polishing pad and contain them for recycling at a later time. The present invention may also employ an optional slurry recycle unit for filtering and recycling the removed slurry, either in conjunction with the slurry container, or in place of slurry container.

BRIEF DESCRIPTION OF THE DRAWINGS

The present invention is illustrated by way of example and not by way of limitation, in the figures of the accompanying drawings and in which like reference numerals refer to similar elements and in which.

DETAILED DESCRIPTION OF THE INVENTION

A Method and System for Vacuum Removal of Chemical Mechanical Polishing By-Products A method and system for vacuum removal of CMP machine polishing by-products is disclosed. In the following description, for the purposes of explanation, numerous specific details are set forth in order to provide a thorough understanding of the present invention. It will be obvious, however, to one skilled in the art that the present invention may be practiced without these specific details. In other instances, well-known structures, devices, and processes are shown in block diagram form in order to avoid unnecessarily obscuring the present invention.

Chemical-mechanical polishing (CMP) is the preferred method of obtaining full planarization of a semiconductor wafer containing devices for fabrication processing. The CMP process involves removing all, or a portion of, a layer of dielectric material using mechanical contact between the wafer and a moving polishing pad saturated with a polishing slurry. Polishing through the CMP process flattens out height differences, since high areas of topography (hills) are removed faster than areas of low topography (valleys). The CMP process has the capability of smoothing out topography over millimeter scale planarization distances, leading to maximum angles of much less than one degree after polishing.

The present invention is a vacuum removal system for removing polishing by-products from the surface of a polishing pad in a CMP machine used to polish wafers. The vacuum removal system includes a vacuum removal nozzle which is adapted to dislodge and remove polishing byVLSI product particles from a textured surface of a polishing pad through the application of suction. The vacuum removal nozzle is connected to a mounting attachment. The mounting attachment is mounted on the polishing machine and is adapted to maintain close proximity of the vacuum removal nozzle with the textured surface of the polishing pad. A vacuum line is connected to the vacuum nozzle to convey a vacuum to the vacuum nozzle and to receive the polishing by-product particles from the vacuum nozzle. A vacuum source is connected to the vacuum line to generate the vacuum used by the system. The present invention improves the performance of the polishing pad by removing the polishing by-product particles from the textured surface of the polishing pad. In so doing, a higher removal rate is achieved over a longer period of time. The vacuum removal system of the present invention, in addition, increases the period of time a polishing pad may be utilized in the CMP machine before incurring a time consuming down time for polishing pad change out. The vacuum removal system of the present invention and its benefits are described in greater detail below.

Figure 1:
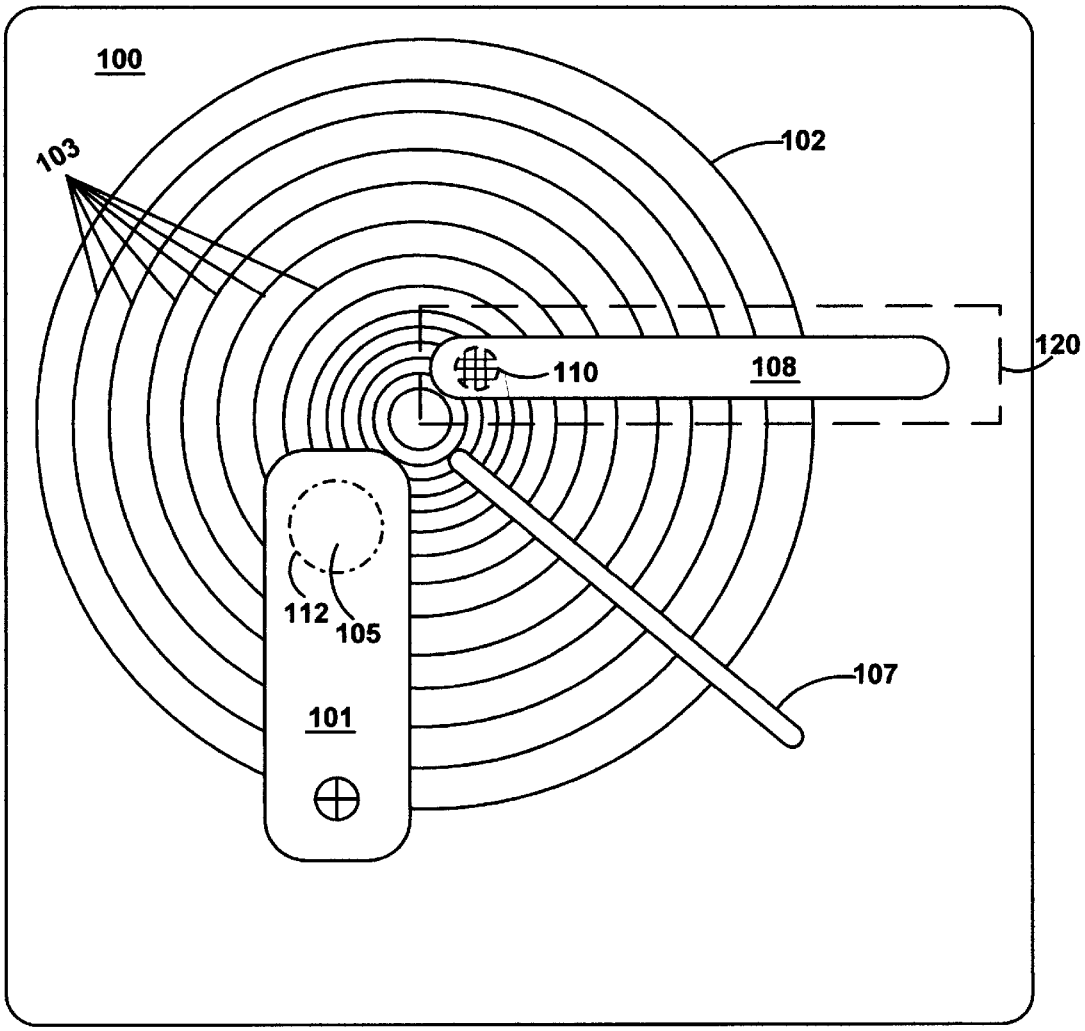
FIG. 1 (Prior Art)
FIG. 1 shows a down view of a prior art CMP machine.
Figure 2:
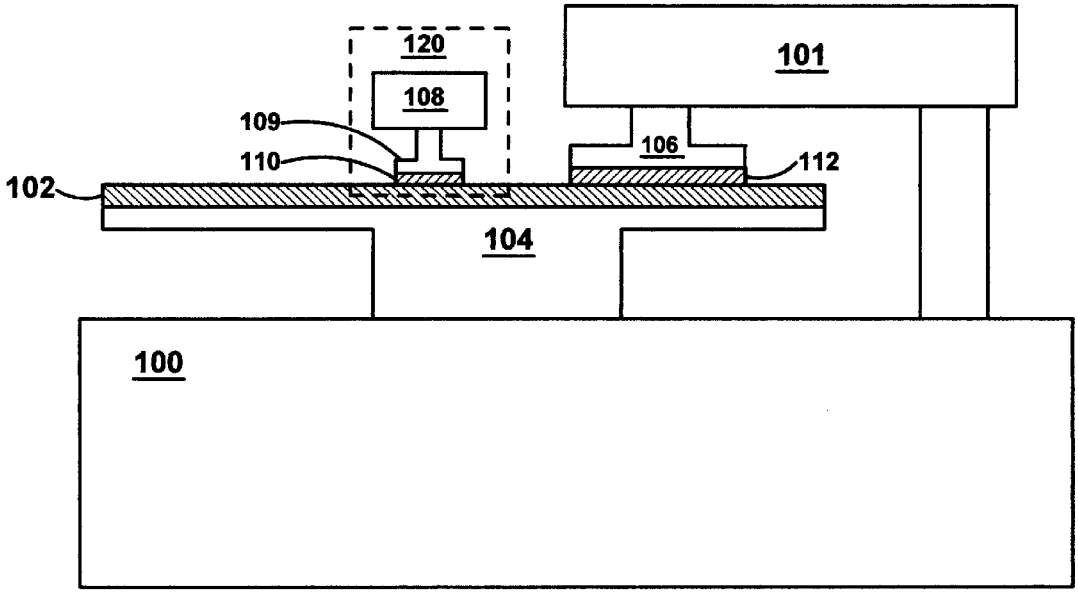
FIG. 2 (Prior Art)
FIG. 2 shows a side view of the prior art CMP machine of FIG. 1.
Figure 3A:
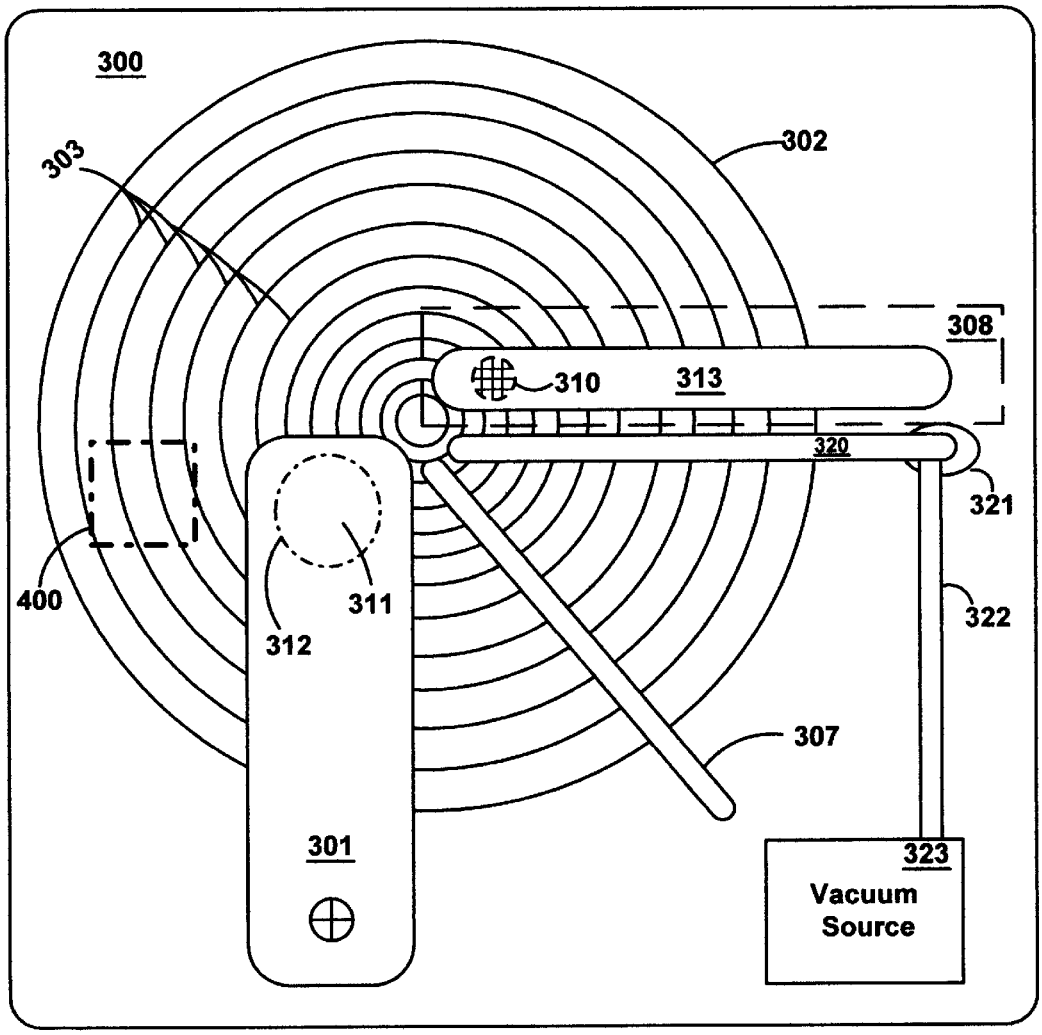
FIG. 3A shows a down view of a CMP machine in accordance with one embodiment of the present invention.
Figure 3B:
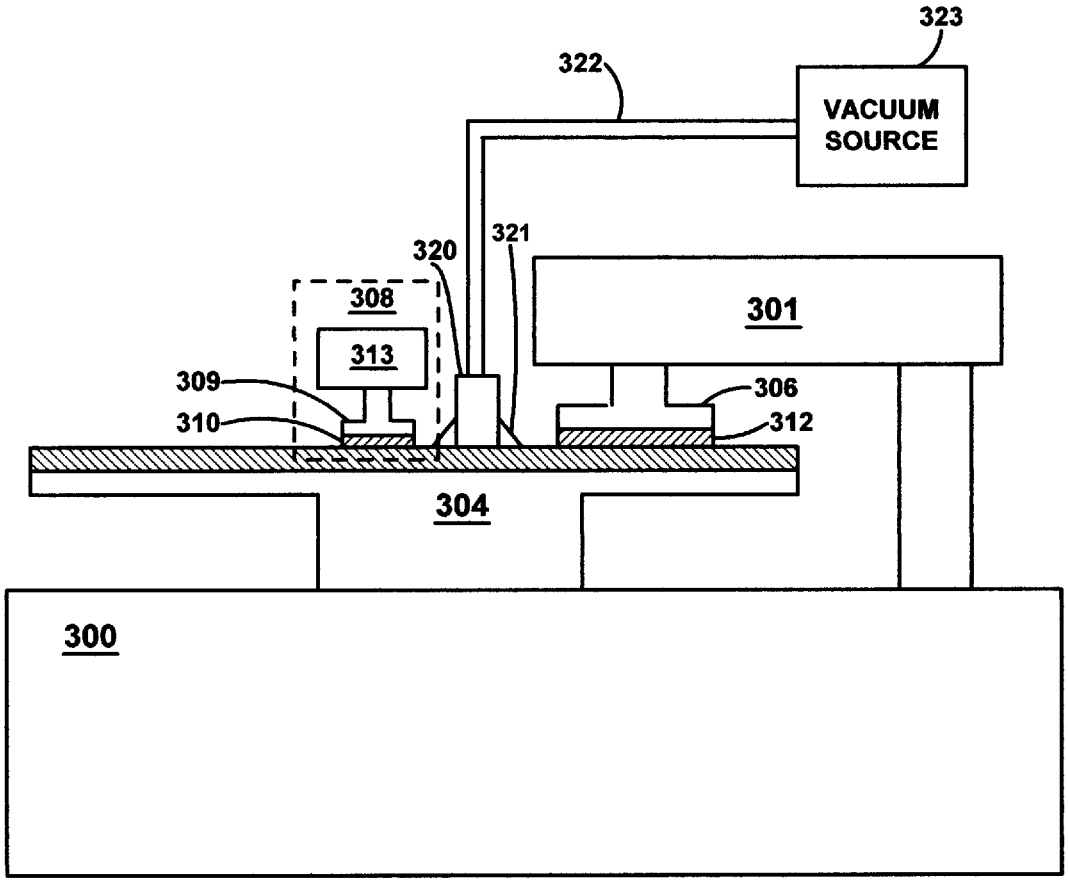
FIG. 3B shows a side view of the CMP machine of FIG. 3A.

FIG. 3A shows a down view and FIG. 3B shows a side view of a CMP machine 300 in accordance with one embodiment of the present invention. The CMP machine 300 picks up wafers with an arm 301 and places them onto rotating polishing pad 302. The polishing pad 302 is made of a resilient material and is textured typically with a plurality of groves or pits 303 to aid the polishing process. As described above, the polishing pad 302, of CMP machine 300, rotates on a platen 304, or turn table located beneath the polishing pad 302, at a predetermined speed. The arm 301 forces a wafer 311 into the polishing pad 302 with a predetermined amount of down force. The wafer 311 is held in place on the polishing pad 302 and the arm 301 by a carrier ring 312 and a carrier film 306. The lower surface of the wafer 311 rests against the polishing pad 302. The upper surface of the wafer 311 is against the lower surface of the carrier film 306 of the arm 301. As the polishing pad 302 rotates, the arm 301 rotates the wafer 311 at a predetermined rate. The CMP machine 300 also includes a slurry dispense arm 307 extending across the radius of the polishing pad 302. The slurry dispense arm 307 dispenses a flow of slurry onto the polishing pad 302. A conditioner assembly 308, including an end effector 309 and a conditioner arm 313, extends across the radius of the polishing pad 302. The end effector 309 includes an abrasive conditioning disk 310 which is used to roughen surface of the polishing pad 302, in the manner described above.

In the present embodiment, a vacuum removal nozzle 320 is mounted on CMP machine 300 by a mounting attachment 321. The vacuum removal nozzle 320 extends across the radius of the polishing pad 302 and is held in close proximity with the surface of polishing pad 302 by mounting attachment 321, such that as the polishing pad 302 rotates, the vacuum removal nozzle 320 covers nearly the entire surface of polishing pad 302. The nozzle 320 is adapted to employ suction to the surface of the polishing pad 302 in order to dislodge and remove polishing by-product particles from the surface of the polishing pad 302. A vacuum line 322 is connected to the vacuum removal nozzle 320 and to a vacuum source 323, such that the vacuum line 322 conveys a vacuum generated by the vacuum source 323 to the vacuum removal nozzle 320. The vacuum line 322 also receives the polishing by-product particles removed by the vacuum removal nozzle 320. The polishing by-product particles and other material removed from the surface of the polishing pad are, in turn, received by the vacuum source and discharged into a polishing by-product container 324. In the present embodiment, the polishing platen 304 rotates in a clockwise direction, such that the polishing pad 302 is conditioned by the conditioner assembly 308, is "cleansed" by the vacuum removal nozzle 320, receives fresh slurry from the slurry dispense arm 307, and frictionally contacts the wafer 311, in respective order, thus ensuring optimal polishing conditions for the wafer 311. It should be appreciated that there are numerous functional configurations for the vacuum removal nozzle 320 and mounting attachment 321. As such, the present invention is equally well suited to employ differing configurations for the vacuum removal nozzle 320 and mounting attachment 321.

Figure 4A:
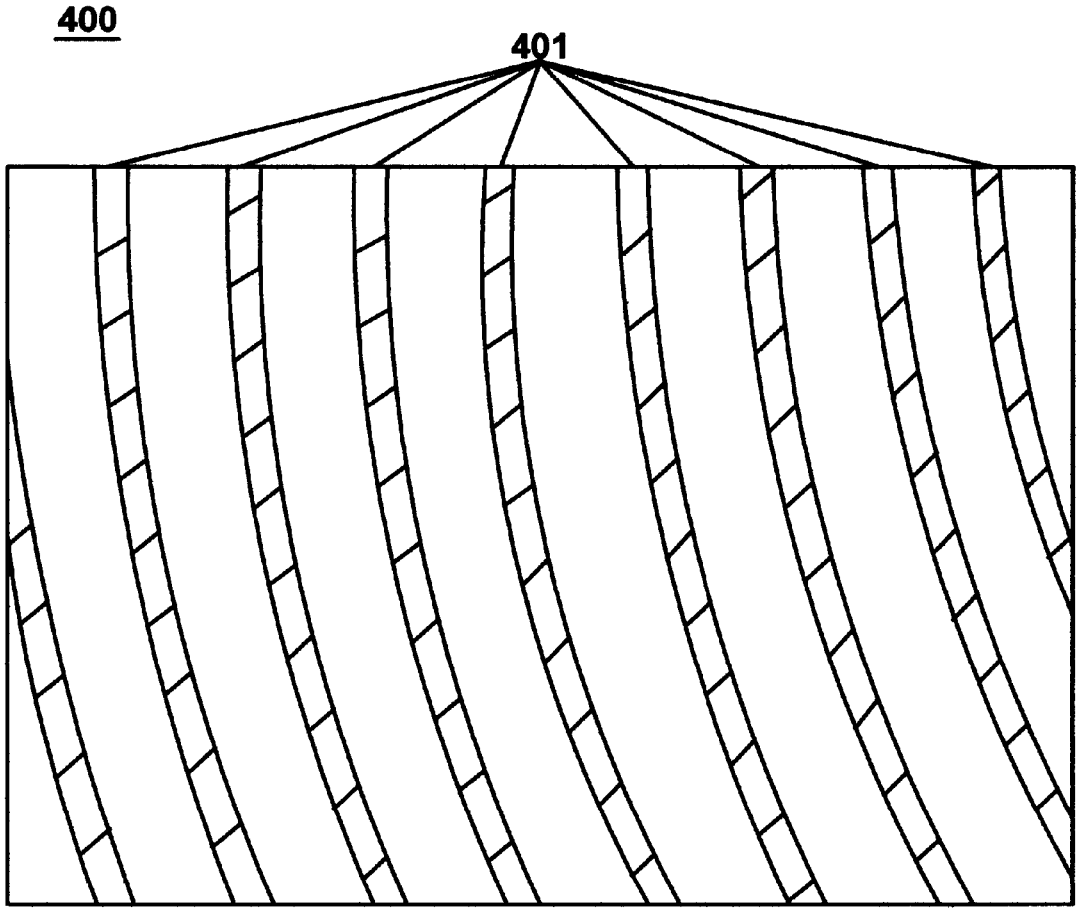
FIG. 4A shows a down view of an enlarged portion of a polishing pad.
Figure 4B:
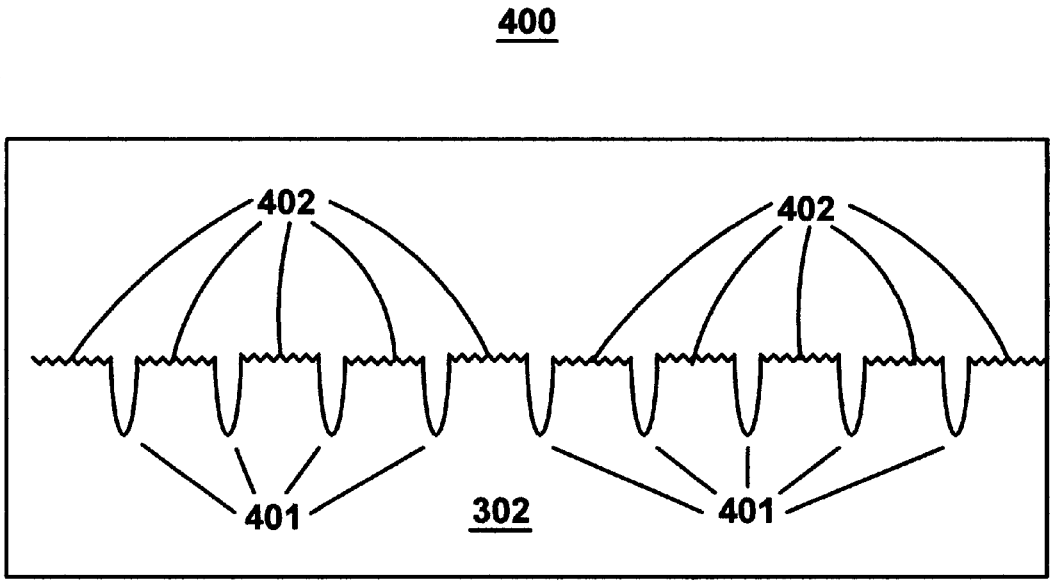
FIG. 4B shows a side view of the enlarged portion of the polishing pad from FIG. 4A.

FIG. 4A shows a down view of an enlarged portion 400 of the polishing pad 302 (FIG. 3A) and FIG. 4B shows a side view of the enlarged portion 400 of the polishing pad 302. Polishing pad 302 includes a plurality of preformed grooves or pits 401 (hereafter grooves 401) manufactured directly into the material of the polishing pad 302. The grooves 401 function by transporting fresh slurry to the surface of the wafer and transporting polishing by-products away from the surface of the wafer. As slurry saturates the polishing pad 302, the grooves 401 become filled with slurry. As the wafer frictionally slides across the surface of the polishing pad 302, slurry adheres to the grooves and scrapes past the edges of the carrier ring 112 and into contact with the lower surface of the wafer. In addition to the grooves 401 , slurry adheres to the actual texture asperity of the material (material texture) comprising the surface of the polishing pad 302, and is transported under the edges of the carrier ring 112 and into contact with the lower surface of the wafer. This material texture is represented by the plurality of surface areas 402. Thus, in the present embodiment, the texture of the surface of the polishing pad 302 is comprised of the preformed grooves 401 and the material texture 402.

The lower surface of the wafer is polished by the chemical action of the slurry, e.g., chemically softening the dielectric layer, and the frictional action of the slurry abrasive particles and polishing pad texture. Thus, as both the pad and the wafer assembly rotate, slurry is "consumed", along with some amount of the texture of the surface of the polishing pad. Consumed slurry and polishing by-products, in a similar manner, also adhere to the texture of the polishing pad and are transported away from the surface of the wafer. As the polishing process continues, fresh slurry is continually dispensed onto the polishing pad from the slurry dispense arm. The polishing action of the slurry filling and adhering to the grooves 401 and the material texture 402 determines the removal rate and removal rate uniformity, and thus, the effectiveness of the CMP process. As slurry is consumed, the transport of fresh slurry to the surface of the wafer and the removal of polishing by-product particles away from the surface of the wafer becomes very important in maintaining the removal rate. The present invention ensures the grooves 401 and the material texture 402 remain clear of polishing by-product particles, and are thus fully able to transport slurry.

Figure 5A:
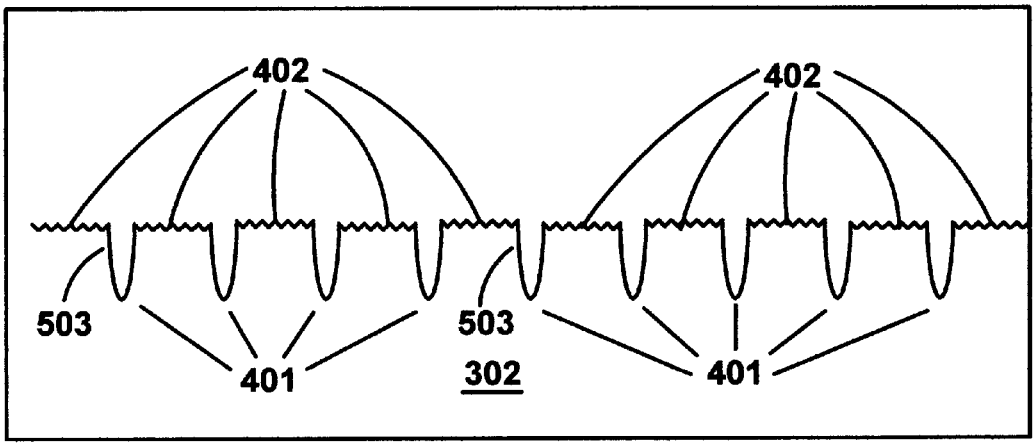
FIG. 5A shows a side view of an enlarged portion of a polishing pad subsequent to conditioning by a conditioner assembly.

FIG. 5A shows a side view of the enlarged portion 400 of the polishing pad 302 subsequent to conditioning by the conditioner assembly 308. To maintain the required degree of roughness in the surface of the polishing pad 302, the conditioner assembly re-roughens the surface of the polishing pad in the manner described above. The abrasive action of the conditioner produces debris comprised of particles of polishing pad material. The particles of polishing pad material, particles of dielectric material from the wafer, particles of consumed slurry, and the like (i.e., by-product particles 503), subsequently clog the predetermined grooves 401 and reduce their ability to transport slurry, thereby, adversely impacting the removal rate. Additionally, the by-product particles 503 adhere to the surface of the wafer and contribute to higher contamination levels. The vacuum removal nozzle 320 (FIG. 3B) of the present invention dislodges and removes the by-product particles 503 through the application of suction to the surface of the polishing pad 302.

Figure 5B:
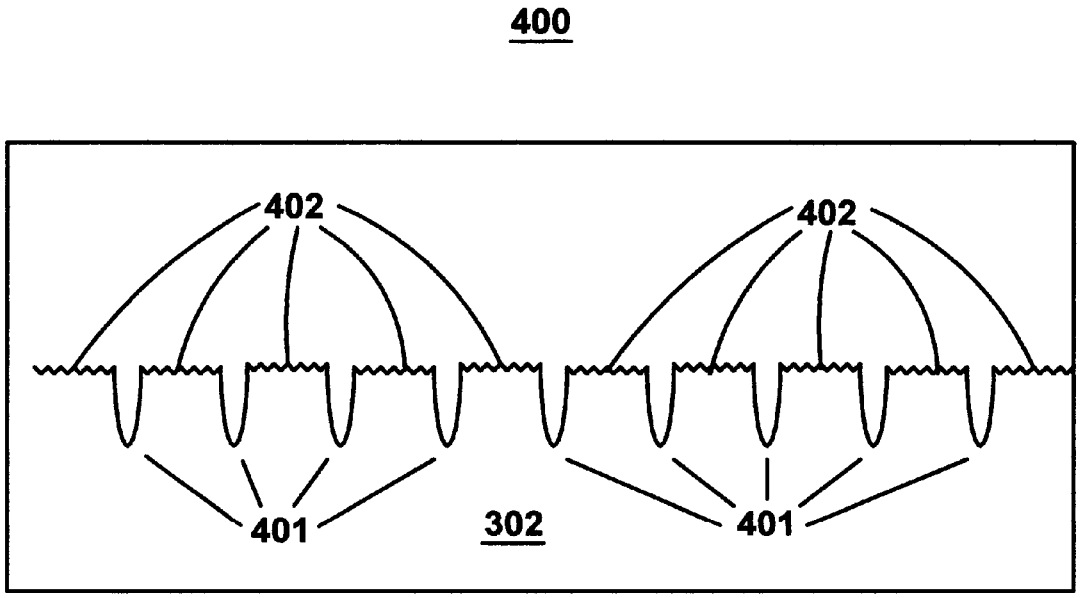
FIG. 5B shows a side view of the enlarged portion of the polishing pad from FIG. 5A subsequent to vacuum removal in accordance with the present invention.

FIG. 5B shows a side view of the enlarged portion 400 of the polishing pad 302 subsequent to vacuum removal in accordance with the present invention. The by-product particles 503 have been removed from the predetermined grooves 401 and the material texture by the suction effect of the vacuum removal nozzle 320. In addition to removing byproduct particles 503, spent slurry has also been removed. The predetermined grooves 401 and the material texture 402 are subsequently saturated by fresh slurry from the slurry dispense arm prior to contact with the wafer.

Figure 6A:
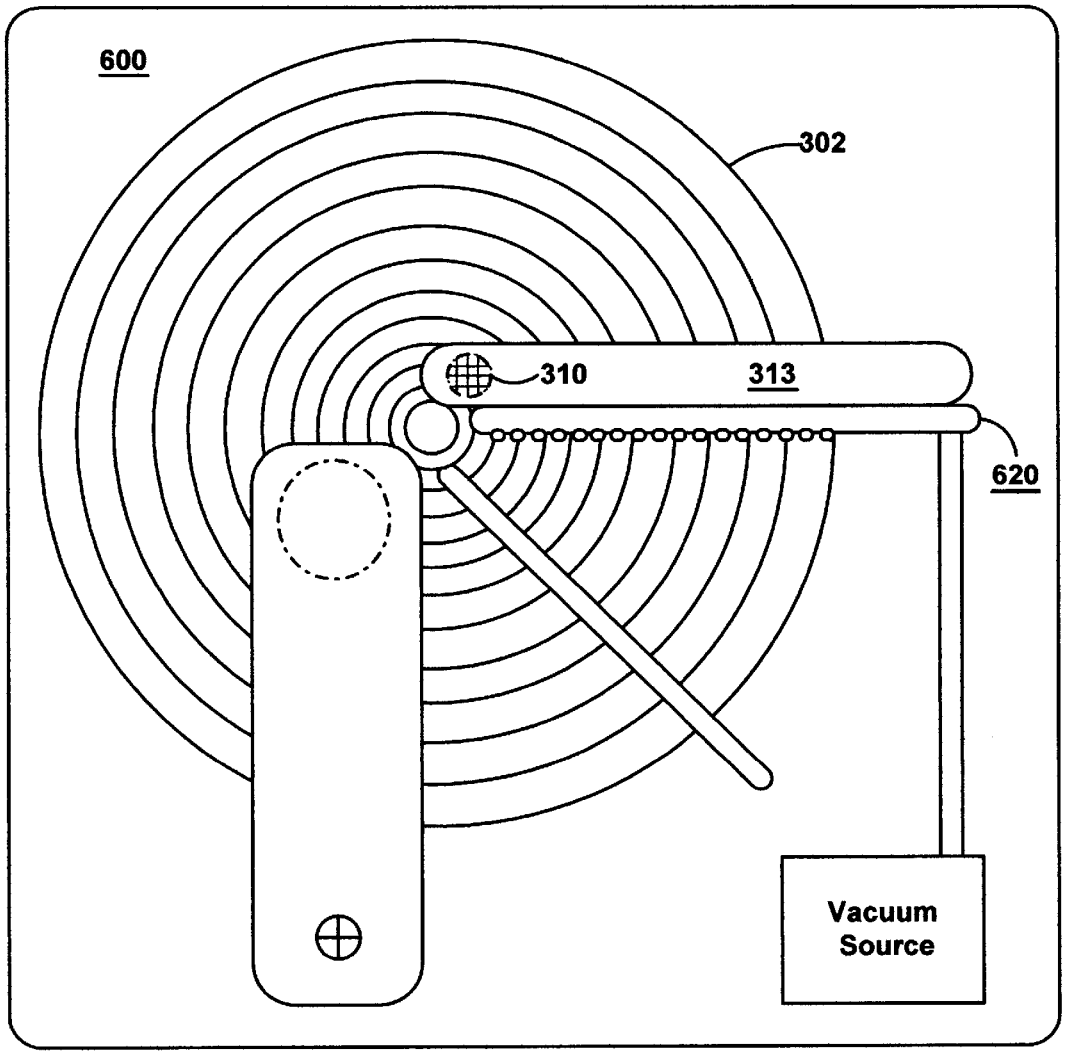
FIG. 6A shows a down view of a CMP machine in accordance with another embodiment of the present invention.
Figure 6B:
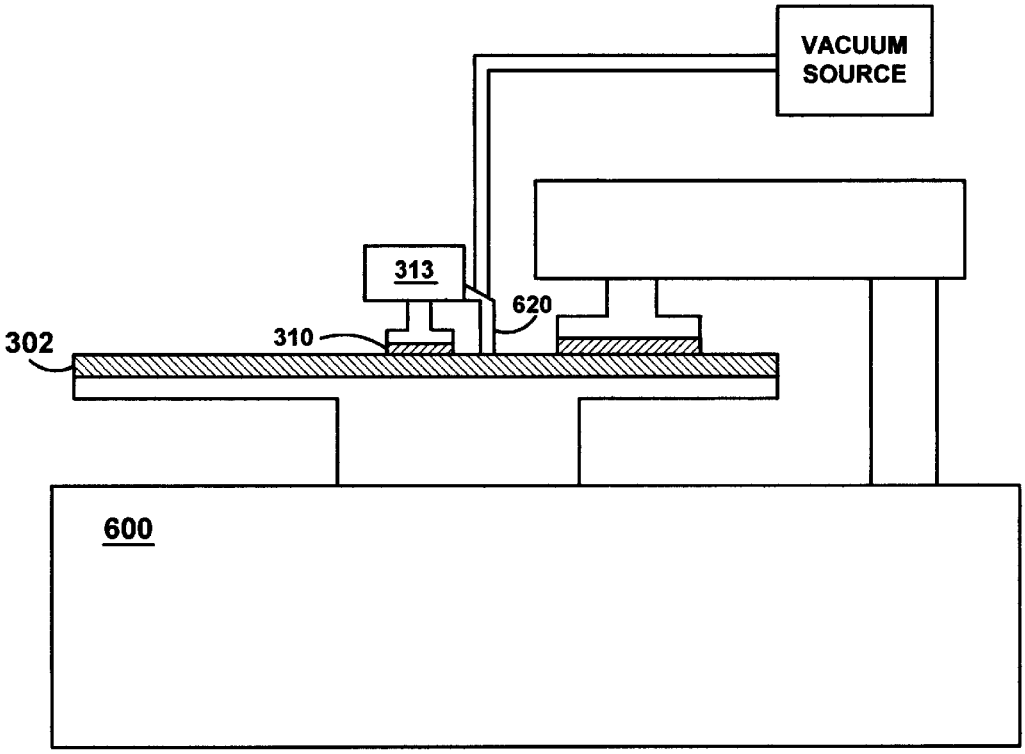
FIG. 6B shows a side view of the CMP machine from FIG. 6A.

FIG. 6A shows a CMP machine 600 in accordance with another embodiment of the present invention. FIG. 6B shows a side view of the CMP machine 600. In this embodiment, the vacuum removal nozzle is comprised of a plurality of fixed vacuum ports 620 mounted on the conditioner arm 313. The fixed vacuum ports are adapted to maintain close proximity with the surface of the polishing pad 302. As the polishing pad 302 rotates beneath the fixed vacuum ports, the vacuum ports cover nearly the entire surface area of the polishing pad 302. CMP machine 600 rotates the polishing pad 302 in a clockwise direction, thus, vacuum ports 602 are mounted on the conditioner arm 313 in such a manner as to dislodge and remove by suction polishing by-product particles from the surface of the polishing pad 302 immediately after polishing pad 302 is roughened by the abrasive disk 310, thereby ensuring optimal polishing conditions for the wafer 311. It should be appreciated that there are numerous functional configurations and mounting locations for the plurality of fixed vacuum ports 620 (e.g., fixed vacuum ports 620 can be mounted on slurry dispense arm 307). As such, the present invention is equally well suited to employ differing configurations and mounting locations for the vacuum removal nozzle 620.

Figure 7A:
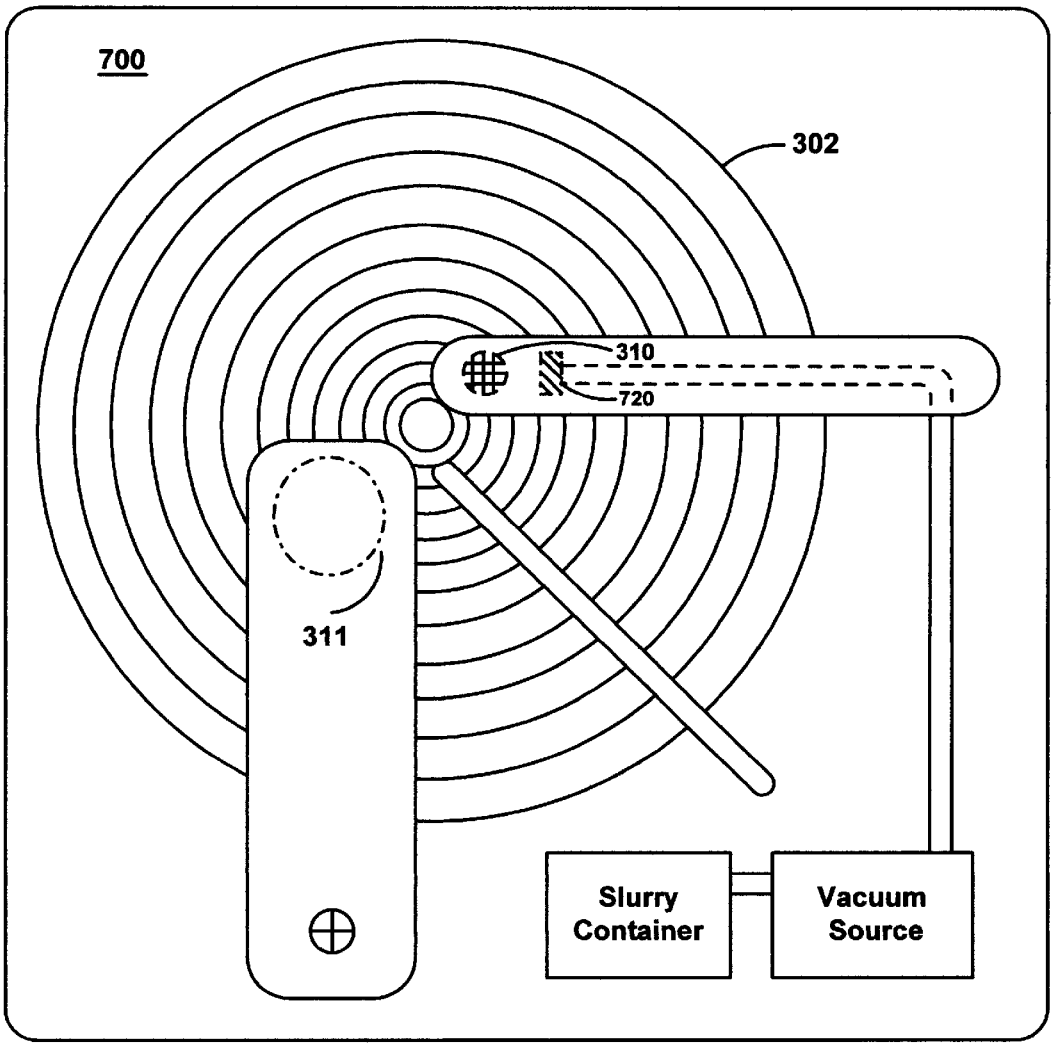
FIG. 7A shows a down view of a CMP machine in accordance with another embodiment of the present invention.
Figure 7B:
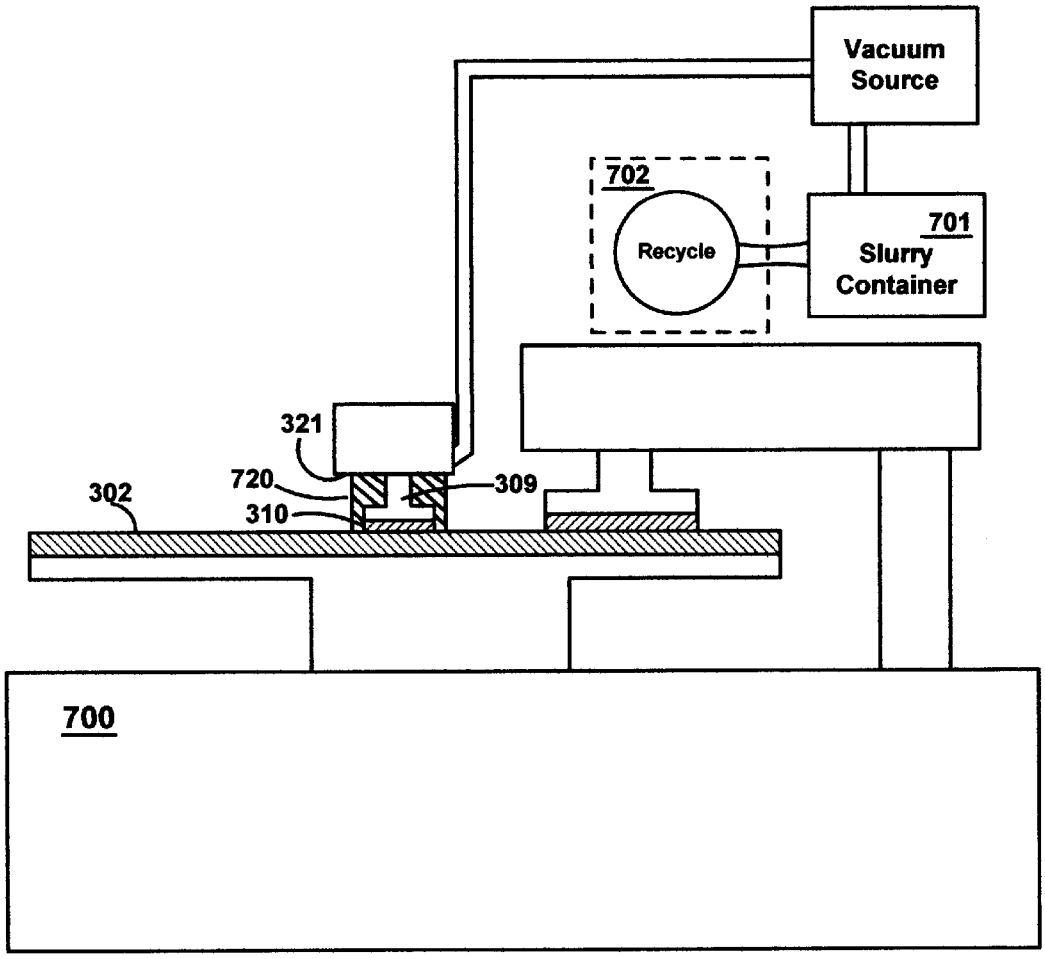
FIG. 7B shows a side view of the CMP machine from FIG. 7A.

FIG. 7A shows a CMP machine 700 in accordance with yet another embodiment of the present invention. FIG. 7B shows a side view of the CMP machine 700. In this embodiment, the vacuum removal nozzle is comprised of a single vacuum port 720 mounted on the conditioner arm 313, such that the vacuum port 720 follows the end effector 309 as it moves toward the center of the polishing pad 302 and away from the center. The vacuum port 720 is adapted to maintain close proximity with the surface of the polishing pad 302. As the polishing pad 302 rotates, the vacuum port 720 "scans" toward and away from the center of polishing pad 302 such that the vacuum port 720 covers nearly the entire surface of polishing pad 302. Vacuum port 720 follows the end effector 309 and is thus adapted to dislodge and remove by suction polishing by-product particles from the surface of the polishing pad 302 immediately after polishing pad 302 is roughened by the abrasive disk 310, thereby ensuring optimal polishing conditions for the wafer 311. As described above, it should be appreciated that there are numerous functional configurations for the vacuum port 720 and mounting attachment 321 (e.g., the vacuum removal nozzle can employ dual vacuum ports on either side of the end effector 309). As such, the present invention is equally well suited to employ differing configurations for the vacuum port 720.

Referring still to FIG. 7A and FIG. 7B, CMP machine 700 further includes a slurry container 701 connected to vacuum source 323. Slurry container 701 is adapted to receive the slurry and polishing by-product particles removed from the polishing pad 302. As the system of the present invention functions, slurry container 701 contains the slurry and byproduct particles for recycling at a later time. The present invention may also employ an optional slurry recycle unit 702, for filtering and recycling the removed slurry, either in conjunction with the slurry container 701 as shown in FIG. 7, or in place of slurry container 701. By recycling "consumed" slurry, CMP processing cost are reduced.

Figure 8:
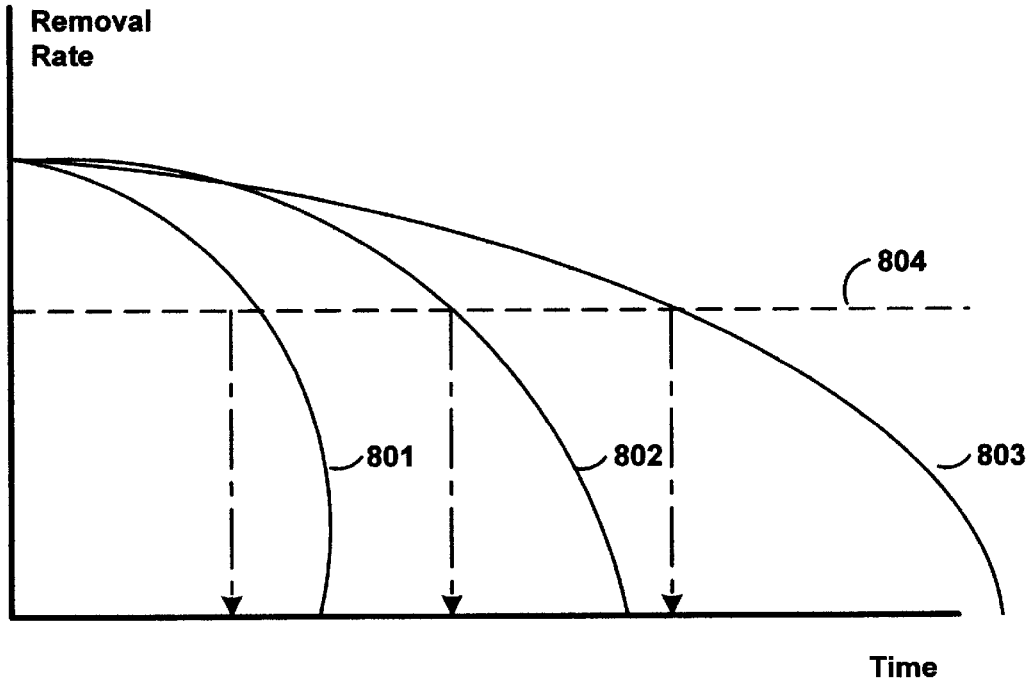
FIG. 8 shows a graph of the removal rate with respect to time of a CMP machine in accordance with the present invention.

Referring now to FIG. 8, a graph 800 of the removal rate of a CMP machine in accordance with the present invention is shown with respect to time. The graph 800 shows three different cases of CMP processing. Line 801 shows the removal rate over time of a CMP machine processing a wafer without conditioning of the CMP machine's polishing pad and without vacuum removal of polishing by-product particles. Line 802 shows the removal rate over time of a CMP machine processing a wafer with conditioning but without vacuum removal of polishing by-product particles. Line 803 shows the removal rate over time of a CMP machine processing a wafer with conditioning and with vacuum removal of polishing by-product particles.

The slurry used in the CMP machine, a mixture of de ionized water and polishing agents, is designed to chemically aid the smooth and predictable planerization of the wafer. The rotating action of both the polishing pad and the wafer, in conjunction with the polishing action of the slurry, combine to planerize a wafer at a nominal rate referred to as a removal rate. A constant predictable removal rate is important to the uniformity and performance of the wafer fabrication process. The removal rate should be expedient, yet yield precisely planerized wafers, free from surface anomalies. If the removal rate is too slow, the number of planarized wafers produced in a given period of time decreases, hurting the wafer through-put of the fabrication process. If the removal rate is too fast, the CMP planarization process will not be uniform across the surface of the wafers, hurting the yield of the fabrication process. By employing the vacuum removal system of the present invention, the removal rate (line 803) is maintained above a minimum "quality threshold" represented by line 804 for the longest period of time in comparison to line 802 and line 801.

Polishing without conditioning and without vacuum removal, line 801, results in rapid drop off of removal rate due to the fact that the polishing process results in a gradual erosion of the surface texture of the polishing pad. The erosion of the surface texture adversely impacts the rate at which slurry flows to the surface of the wafer, resulting in the rapid drop off of removal rate as successive wafers are polished. Thus, line 801 quickly falls below the quality threshold 804, thereby causing a greater number of CMP machine down times for polishing pad change out.

Polishing with conditioning but without vacuum removal, line 802, results in a less rapid drop off of removal rate in comparison to line 801 due to the fact that the gradual erosion of the surface texture of the polishing pad is counteracted by conditioning. The conditioner assembly roughens the surface of the polishing pad, maintaining adequate surface texture for a longer period of time. The abrasive action of the conditioner assembly, however, produces by-product particles comprised of particles of polishing pad material, which clog the predetermined grooves or pits of the polishing pad, as described above. The clogging effects of these by-product particles leads to the gradual reduction in the rate of slurry flow to the wafer as successive wafers are polished. Thus, line 802 results in a less rapid drop off of removal rate in comparison to line 801, however, a greater number of CMP machine down times for polishing pad change out are required in comparison to conditioning in conjunction with the vacuum removal process of the present invention, line 803.

Referring still to FIG. 8, polishing with conditioning and with vacuum removal in accordance with the present invention, line 803, results in an even less rapid drop off of removal rate in comparison to line 801 and 802. As the conditioner assembly roughens the surface of the polishing pad, the polishing by-product particles are dislodged and removed from the predetermined grooves or pits of the polishing pad in the manner described above. The vacuum removal process of the present invention eliminates the clogging effects of the by-product particles, and in so doing, eliminates the gradual reduction in the rate of slurry flow to the wafer attributable to the clogging effects. Thus, line 803 results in a longer "service life" of the polishing pad and longer periods of operation between time consuming down times for polishing pad change out. The longer service life has a positive effect on the fabrication through put of CMP machines in accordance with the present invention.

CMP machines in accordance with the present invention can also employ a periodic "rinse" of the polishing pad to aid in dislodging the byproduct particles. When the by-product particles are dislodged in this manner they are quickly removed by the suction of the vacuum removal nozzle, as opposed to merely moving from one location on the surface of the polishing pad to another. Additionally, the vacuum removal of by-product particles reduces the amount of contamination of the wafers attributable to the adherence of by-product particles to the surface of the wafers. As an even further benefit, CMP processing in accordance with the present invention, line 803, maintains the stability of the removal rate for longer periods of time in comparison to line 802 and line 801. The drop off in removal rate is slower and more predictable. These characteristics are important to maintaining acceptable uniformity of removal, i.e., the relative planarity of the surface of the dielectric layer of the wafer after polishing.

Figure 9:
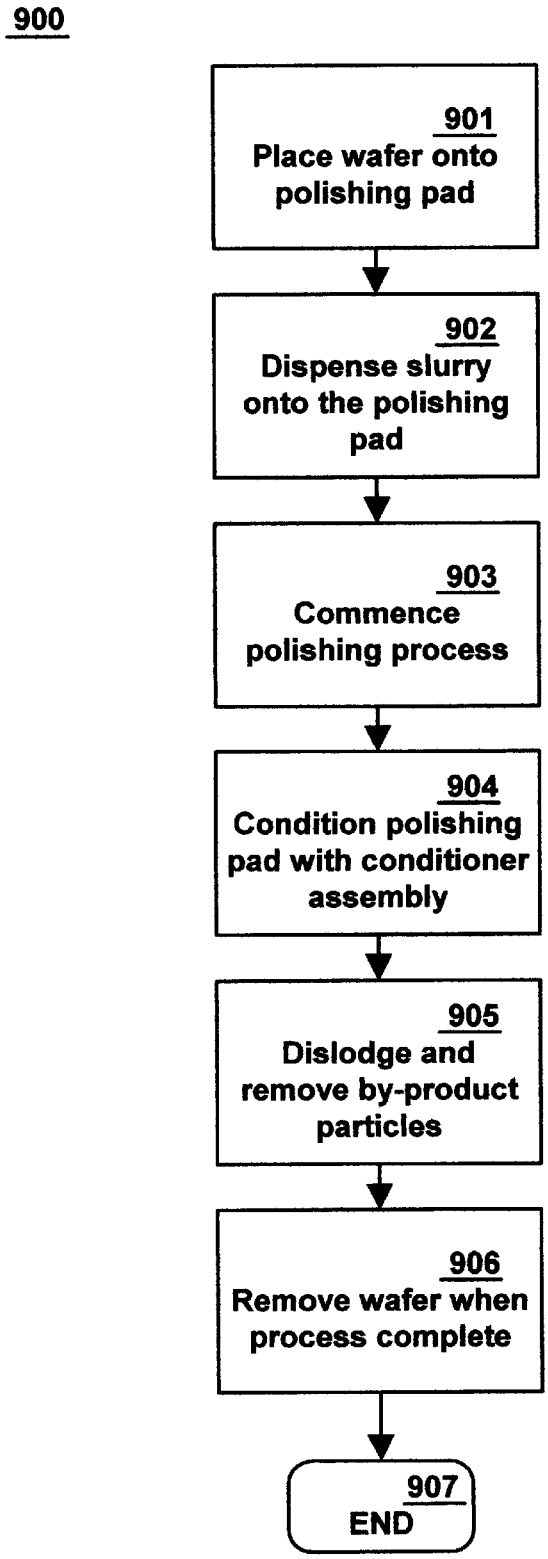
FIG. 9 shows a flow chart of the steps of a vacuum removal process in accordance with the present invention.

Referring now to FIG. 9, a flow chart of the steps of the vacuum removal process 900 in accordance with one embodiment of the present invention is shown. Process 900 is used to polish wafers to the proper degree of planarization using the vacuum removal system of the present invention. In step 901, the arm of the CMP machine grabs a wafer to be polished and places it onto the rotating polishing pad of the CMP machine. The polishing pad is previously coated with a layer of slurry. The slurry is dispensed from a slurry dispense arm, as described above. In step 902, a flow of slurry containing polishing agents is dispensed onto the polishing pad. This flow of slurry maintains a coating of slurry on the polishing pad. In step 903, the wafer is confined by the arm to the polishing pad as the polishing pad rotates. In addition to the polishing pad rotating, the wafer is rotated by the arm and the polishing process is carried out by the combined motion of both the polishing pad and the wafer. The friction of the wafer against the polishing pad, in conjunction with the action of the slurry, removes material from the wafer at a nominal removal rate. In step 904, the polishing pad is roughened by the conditioning assembly. In step 905, polishing by-product particles are dislodged and removed by the vacuum removal system of the present invention. In step 906, the wafer is removed from the polishing pad when the polishing process is complete and the wafer is sufficiently planarized.

Thus, the vacuum removal system of the present invention improves the performance of a polishing pad in a CMP machine. The present invention maintains a higher removal rate in a CMP machine over a longer period of time. In addition, the vacuum removal system of the present invention increases the period of time a polishing pad may be utilized in a CMP machine before incurring a time consuming down time for polishing pad change out.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A vacuum removal system for removing polishing by-product particles and efficiently removing conditioning by-product particles from a surface of a polishing pad in a wafer polishing machine, comprising:

a vacuum removal nozzle adapted to dislodge and remove polishing by-product particles from a textured surface of a polishing pad by suction;

a mounting attachment connected to said vacuum removal nozzle, said mounting attachment mounted on a conditioner arm of a polishing machine and adapted to maintain close proximity of said vacuum removal nozzle with said textured surface, said mounting attachment adapted to mount said vacuum removal nozzle onto said conditioner arm such that conditioning by-product particles are efficiently removed;

a vacuum line connected to said vacuum nozzle to convey a vacuum to said vacuum nozzle and to receive said polishing by-product particles and said conditioning by-product particles from said vacuum nozzle; and a vacuum source connected to said vacuum line to generate said vacuum.

2. The vacuum removal system of claim 1, wherein said vacuum removal nozzle is adapted to dislodge said polishing by-product particles from a plurality of predetermined grooves formed into said textured surface.

3. The vacuum removal system of claim 1, wherein said vacuum removal nozzle is adapted to dislodge said polishing by-product particles from a plurality of predetermined pits formed into said textured surface of said polishing pad.

4. The vacuum removal system of claim 1, further comprising:

said mounting attachment mounted on said conditioner arm of said wafer polishing machine such that said mounting attachment maintains close proximity of said vacuum nozzle with said textured surface; and said vacuum nozzle having a plurality of vacuum ports, wherein each of said plurality of vacuum ports is adapted to dislodge and remove said polishing by-product particles and said conditioning by-product particles from said textured surface by suction.

5. The vacuum removal system of claim 1, further comprising:

said mounting attachment mounted on said conditioner arm of said wafer polishing machine such that said mounting attachment maintains close proximity of said vacuum removal nozzle with said textured surface;

said vacuum removal nozzle having a single port, said vacuum removal nozzle adapted to scan across said polishing pad cooperatively with said conditioner arm to cover an area of said polishing pad, said vacuum nozzle adapted to dislodge and remove said polishing by-product particles and said conditioning by-product particles from said textured surface by suction.

6. The vacuum removal system of claim 1, wherein said vacuum removal nozzle is also adapted to remove consumed slurry from said textured surface.

7. The vacuum removal system of claim 6 further comprising:

a slurry container connected to said vacuum source to receive a flow including said consumed slurry and said polishing by-product particles from said vacuum source, said consumed slurry and said polishing by-product particles removed by said vacuum nozzle from said textured surface and contained by said slurry container.

8. The vacuum removal system of claim 6, further comprising:

a slurry recycling unit connected to said slurry container to receive said flow from said slurry container, said slurry recycling unit adapted to recycle said consumed slurry from said flow.

9. A vacuum removal system for removing polishing by-products from a wafer and efficiently removing conditioning by-product particles from a polishing pad in a chemical mechanical polishing machine comprising:

a wafer detachably mounted on said polishing machine;

a polishing pad mounted on said polishing machine for polishing said wafer, said wafer disposed against said polishing pad, said polishing pad frictionally moved against said wafer by said polishing machine, said polishing pad having a textured surface for carrying fresh slurry to said wafer and for removing consumed slurry and polishing by-product particles from said wafer; and a vacuum removal nozzle adapted to dislodge and remove said polishing by-product particles from said textured surface by suction, said vacuum removal nozzle mounted on a conditioner arm of said polishing machine such that said vacuum removal nozzle maintains close proximity with said textured surface as said textured surface moves in relation to said vacuum removal nozzle to efficiently remove conditioning by-product particles.

10. The vacuum removal system of claim 9, further comprising:

a vacuum source to generate a vacuum; and a vacuum line connected to said vacuum source and connected to said vacuum removal nozzle to convey said vacuum to said vacuum removal nozzle and to receive said polishing by-product particles and said consumed slurry from said vacuum nozzle.

11. The vacuum removal system of claim 10, further comprising:

said vacuum removal nozzle mounted on said conditioner arm of said polishing machine such that said vacuum removal nozzle maintains close proximity with said textured surface; and a plurality of vacuum ports formed in said vacuum nozzle, wherein each of said plurality of vacuum ports is adapted to dislodge and remove said polishing by-product particles said conditioning by-product particles and said consumed slurry from said textured surface by suction.

12. The vacuum removal system of claim 10, further comprising:

said vacuum removal nozzle mounted on said conditioner arm of said polishing machine such that said vacuum removal nozzle maintains close proximity with said textured surface, said vacuum removal nozzle having a single port, said vacuum removal nozzle adapted to scan across said polishing pad to cover an area of said polishing pad, said vacuum nozzle adapted to dislodge and remove said polishing byproduct particles, said conditioning by-product particles and said consumed slurry from said textured surface by suction.

13. The vacuum removal system of claim 10 further comprising:

a slurry container connected to said vacuum source to receive a flow including said consumed slurry and said polishing by-product particles from said vacuum source, said consumed slurry and said polishing by-product particles removed by said vacuum nozzle from said textured surface and contained by said slurry container.

14. The vacuum removal system of claim 10, further comprising: a slurry recycling unit connected to said slurry container to receive said flow from said slurry container, said slurry recycling unit adapted to recycle said consumed slurry from said flow.

15. In a chemical mechanical polishing machine, a method of polishing a wafer , said method comprising the steps of:

(a) placing the wafer onto a polishing pad of a chemical mechanical polishing machine;

(b) dispensing slurry onto said polishing pad;

(c) polishing said wafer through a combined action of frictionally moving said wafer against a surface of said polishing pad and flowing said slurry into contact with said wafer; and (d) dislodging and removing polishing by-product particles and conditioning by-product particles from said surface of said polishing pad by employing suction from a vacuum removal nozzle mounted on a conditioner arm of said chemical mechanical polishing machine such that said wafer is optimally polished by said combined action.

16. The method of claim 15 further including the step of automatically removing said wafer from said polishing pad when said wafer is sufficiently polished.

17. The method of claim 15 further including the step of conditioning said surface with a conditioner assembly.

18. A vacuum removal system for removing conditioning by-product particles including polishing pad particles from the surface of a polishing pad in a chemical mechanical polishing machine for polishing semiconductor wafers, comprising:

a vacuum removal nozzle adapted to dislodge and remove conditioning by-product particles from a textured surface of a polishing pad by suction, said vacuum nozzle having a plurality of vacuum ports, wherein each of said plurality of vacuum ports is disposed to dislodge and remove said conditioning by-product particles from a plurality of predetermined grooves formed into said textured surface;

a mounting attachment connected to said vacuum removal nozzle, said mounting attachment mounted on a conditioner arm of a polishing machine and adapted to maintain close proximity of said vacuum removal nozzle with said textured surface, said mounting attachment adapted to mount said vacuum removal nozzle in close proximity to said conditioner arm such that said conditioning by-product particles are efficiently removed as said conditioner arm conditions said polishing pad;

a vacuum line connected to said vacuum nozzle to convey a vacuum to said vacuum nozzle and to receive polishing by-product particles and said conditioning by-product particles from said vacuum nozzle; and a vacuum source connected to said vacuum line to generate said vacuum.

19. The vacuum removal system of claim 18, further comprising:

said vacuum removal nozzle adapted to scan across said polishing pad in a cooperative manner with an end effector of said conditioning arm to cover an area of said polishing pad as said end effector covers said area of said polishing pad, said vacuum nozzle adapted to dislodge and remove said conditioning by-product particles as said end effector conditions said polishing pad.

* * * * *